US005082250A

United States Patent [19]

Cristiani et al.

[11] Patent Number: 5,082,250

[45] Date of Patent: Jan. 21, 1992

[54] DEVICE TO HEAT THE LEADING END OF ALUMINIUM INGOTS TO BE EXTRUDED

[75] Inventors: Giancarlo Cristiani, Gorizia; Danilo D'Odorico, Compoformido, both of Italy

[73] Assignee: Danieli & C. Officine Meccaniche SpA, Buttrio, Italy

[21] Appl. No.: 548,831

[22] Filed: Jul. 6, 1990

[30] Foreign Application Priority Data

Jul. 19, 1989 [IT] Italy ..... 83459 A/89

[51] Int. Cl.[5] ..... B21C 23/00

[52] U.S. Cl. ..... 266/44; 266/249; 72/253.1

[58] Field of Search ..... 266/249, 259, 260, 44; 72/270, 271, 253.1; 148/2

[56] References Cited

U.S. PATENT DOCUMENTS 3,173,283 3/1965 Vogtmann ..... 72/253.1
4,308,742 1/1982 Harrison et al. ..... 72/270
4,895,506 1/1990 Nonini et al. ..... 425/184

FOREIGN PATENT DOCUMENTS 0619919 3/1949 United Kingdom .
0931973 7/1963 United Kingdom .

*Primary Examiner*—S. Kastler
*Attorney, Agent, or Firm*—Antonelli, Terry, Stout & Kraus

[57] ABSTRACT

Device to heat the leading end of aluminium ingots to be extruded when hot in extruder presses, with chambers containing the ingots arranged turret-wise with their axes parellel, the device being arranged in cooperation with the frontal end part of a chamber (12) which will cooperate with the extruder die, and in correspondence with the position for loading and readying an ingot (13), this position being located immediately upstream of the extrusion position.

Method to heat the leading end (14) of a hot aluminium ingot (13) held in a chamber (12) located in a position to load and position an ingot immediately upstream of the extrusion position in a turret-type extrusion press, the leading end (14) being extracted from the chamber (12) and caused to protrude therefrom (12) and being then heated by induction and re-inserted thereafter in the chamber (12) immediately before the chamber (12) is placed in its extrusion position and the ingot (13) is extruded.

7 Claims, 1 Drawing Sheet

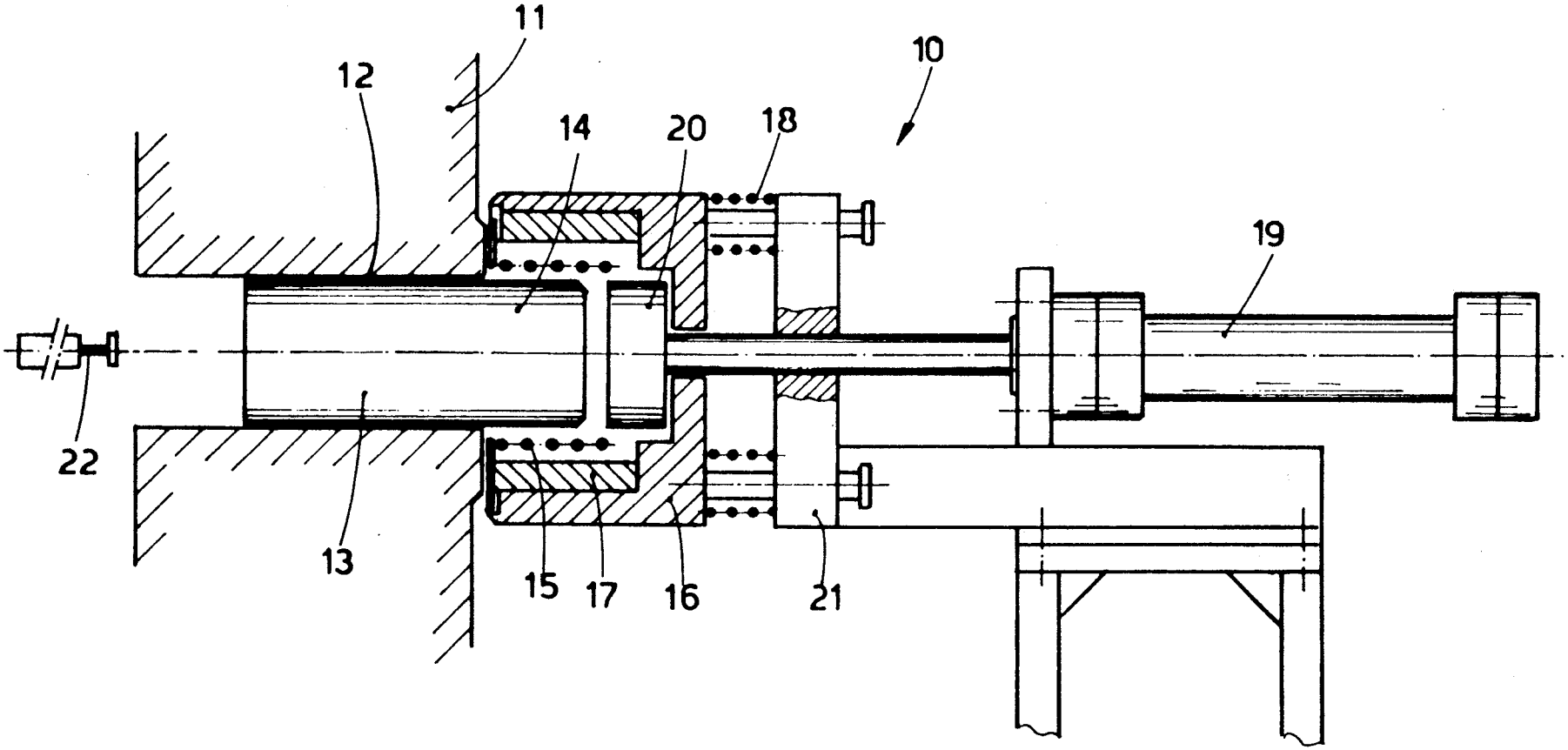
10
11
12
13
14
15
16
17
18
19
20
21
22

DEVICE TO HEAT THE LEADING END OF ALUMINIUM INGOTS TO BE EXTRUDED

BACKGROUND OF THE INVENTION

This invention concerns a device to heat the leading end of aluminum ingots to be extruded when hot in a turret-type extrusion press. The invention concerns also a method to heat the leading end of ingots to be extruded.

To be more exact, the invention concerns a device to heat the leading end part of aluminum ingots, the device being applied to the chamber for insertion and readying of the ingots.

According to the invention the heater device is located in cooperation with that part of the chamber which cooperates directly with the extruder die.

A press of this type is disclosed in EP-A-0318621.

It is known that during the hot extrusion operation the temperature of the ingot rises from about 400° C. at the beginning to 500° C. at the end.

This occurrence requires a greater initial thrust and a lesser final thrust since with an increase of the temperature it is necessary to reduce the extrusion pressure as a consequence.

Various arrangements have been studied in trying to keep the extrusion capacity constant, that is to say, in trying to keep the extrusion at a high and optimum value.

A first arrangement is to heat the ingot with conventional means to a greater extent in the part which will come in contact with the die at once and then to insert the ingot into the chamber just before the chamber is rotated to take up its extrusion position.

This is a good arrangement theoretically but in actual practice entails the drawback that the movement and positioning times are such as to nullify the benefits.

A second arrangement consists in cooling the trailing end of the ingot just before it is inserted in the chamber, but this arrangement too has not given good results and is also counterproductive from the point of view of energy.

Trials have also been conducted with heating the leading end of the ingot with a burner as that end is inserted into the chamber, but these trials have also given bad results owing to the short length thus heated of the ingot and owing to the embrittlement of the chamber due to the increase of temperature of its walls caused by the heating.

The present applicant has now found unexpectedly that it is possible to overcome the shortcomings of the state of the art and to achieve a plurality of advantages by means of the invention.

SUMMARY OF THE INVENTION

According to the invention a hot ingot is inserted as usual into the chamber. Before that chamber is displaced from its loading position to the extrusion position, the ingot is caused to emerge by a desired length at the side where the chamber will cooperate with the extrusion die.

That desired length is then lapped by a heating action obtained by induction for a desired time so as to produce an increase of temperature in that leading end zone of the ingot.

When the ingot has been heated through, it is thrust back into the chamber, and the chamber can be displaced so as to cooperate with the die and the extrusion can be started.

The required heating of the leading end of the ingot is thus achieved a moment before that leading end comes into contact with the die and extrusion begins.

BRIEF DESCRIPTION OF THE DRAWINGS

The attached FIGURE, which is given as a non-restrictive example, shows a possible section of an embodiment of the invention.

DETAILED DESCRIPTION OF THE PREFERRED EMBODIMENT

A device 10 cooperates with a chamber 12 of a rotary chamber press when the chamber 12 is in the station or position for loading an ingot 13.

The device 10 cooperates with the frontal part of the chamber 12, namely with the part of the chamber which thereafter is located directly in contact with the extrusion die.

The chamber 12 is machined in a turret or rotor 11.

Before the chamber 12 is moved from the position for loading the ingot 13 to a position of cooperation with the die for extrusion of the ingot 13, the ingot 13 is extracted forwards so that a tract of its leading end 14 protrudes from the chamber 12.

This extraction may be performed by an auxiliary ram 22 or by the means which insert the ingot 13 into the chamber 12.

The leading end 14 of the ingot 13 thus cooperate with an induction heater 15, which laps and heats the leading end 14.

The induction heater 15 cooperates with a screening shield 17 and is supported and positioned in a container 16, which is held by a support 21 and is resiliently thrust by spring means 18 against the outer periphery of the chamber 12, thus enfolding the leading end 14.

When the induction heater 15 has heated the leading end 14 enough, a thrust head 20 driven by a ram 19 displaces the ingot 13 axially until the leading end 14 is positioned wholly within the chamber 12.

The thrust head 20 is dimensioned so as to rest on the edge of the chamber 12, thus ensuring that the leading end 14 of the ingot 13 coincides with the frontal face of the chamber 12 or is positioned slightly within the chamber so that the positioning and rotation operations can proceed correctly.

The chamber 12 can now be rotated to cooperate with the extrusion die and the extrusion operation can begin.

The extrusion operation will take place in optimum or almost optimum conditions owing to such partial heating of the ingot.

We claim:

1. An apparatus for heating a leading end of aluminum ingots to be extruded when hot through an extruder die, comprising:

a turret having a plurality of chambers in each of which an aluminum ingot can be provided, said chambers having parallel longitudinal axes, and each of said chambers having a frontal end part; and a heater for heating a leading end of an aluminum ingot protruding from the frontal end part of a chamber;

wherein said turret is movable such that each of said chambers can be positioned at at least a first position at which the frontal end part of one chamber cooperates with said heater and a second position at which the frontal end part of said one chamber cooperates with an extruder die.

2. An apparatus according to claim 1, wherein said heater extends in front of a chamber which is at said first position and substantially axially thereto so as to surround said leading end of said aluminum ingot protruding from the frontal end part of said chamber which is at said first position.

3. An apparatus according to claim 2, wherein said heater is an induction heater.

4. An apparatus according to claim 2, further comprising a thrust head provided in front of and movable axially to said chamber at said first position for reinserting the leading end of the aluminum ingot into said chamber at said first position.

5. An apparatus according to claim 3, further comprising a shielding material provided about an outside of said induction heater.

6. An apparatus according to claim 3, wherein said induction heater is provided within a container that is movable axially to said chamber at said first position.

7. A method for heating a leading end of a hot aluminum ingot prior to extrusion of the aluminum ingot through an extruder die, comprising the following series of steps:

extracting a leading and of a hot aluminum ingot from a chamber of a turret to cause said leading end to protrude from a front of said chamber while said chamber is in a first position;

heating said leading end of said ingot by induction;

reinserting said leading end of said ingot into said chamber;

moving said chamber to a second position at which said front of said chamber cooperates with an extruder die; and extruding said ingot through said extruder die.

* * * * *